US005927409A

United States Patent [19]

Turner

[11] Patent Number: 5,927,409

[45] Date of Patent: Jul. 27, 1999

[54] APPARATUS FOR JOINING SECTIONS OF PRESSURIZED CONDUIT

[76] Inventor: William E. Turner, 2081 Dennis La., Bethlehem, Pa. 18015

[21] Appl. No.: 09/122,120

[22] Filed: Jul. 24, 1998

Related U.S. Application Data

[62] Division of application No. 08/751,271, Nov. 18, 1996, Pat. No. 5,816,344.

[51] Int. Cl.[6] ..... E21B 47/01; E21B 17/00

[52] U.S. Cl. ..... 175/40; 175/320

[58] Field of Search ..... 175/40, 45, 320, 175/324; 166/242.6, 242.1

[56] References Cited

U.S. PATENT DOCUMENTS

| | | | |
|---|---|---|---|
| 3,508,766 | 4/1970 | Kessler et al. | 285/21 |
| 3,724,576 | 4/1973 | Roberts | 175/320 |
| 4,206,810 | 6/1980 | Blackman | 175/40 |
| 4,278,138 | 7/1981 | Rowley et al. | 175/320 |
| 4,310,059 | 1/1982 | Moore | 175/320 |
| 4,407,528 | 10/1983 | Anthony | 285/50 |
| 4,423,778 | 1/1984 | Goldsmith | 175/320 |
| 4,548,427 | 10/1985 | Press et al. | 285/55 |
| 4,708,203 | 11/1987 | Walker | 166/241 |
| 4,813,715 | 3/1989 | Policelli | 285/149 |
| 4,862,967 | 9/1989 | Harris | 166/387 |
| 4,875,717 | 10/1989 | Policelli | 285/149 |
| 4,934,460 | 6/1990 | Coronado | 166/386 |
| 4,974,245 | 11/1990 | Mioque et al. | 378/54 |
| 5,082,314 | 1/1992 | Aubry et al. | 285/174 |
| 5,144,245 | 9/1992 | Wisler | 324/338 |
| 5,201,550 | 4/1993 | Burkit | 285/109 |
| 5,280,243 | 1/1994 | Miller | 324/303 |
| 5,332,049 | 7/1994 | Tew | 175/320 |
| 5,348,211 | 9/1994 | White et al. | 228/120 |
| 5,396,232 | 3/1995 | Mathieu et al. | 175/40 |
| 5,467,832 | 11/1995 | Orban et al. | 175/45 |
| 5,507,348 | 4/1996 | Steenwyk et al. | 166/382 |
| 5,530,358 | 6/1996 | Wisler et al. | 324/338 |

FOREIGN PATENT DOCUMENTS 1073429 2/1984 Russian Federation .

*Primary Examiner*—Hoang C. Dang
*Attorney, Agent, or Firm*—Woodcock Washburn Kurtz Mackiewicz & Norris LLP

[57] ABSTRACT

An apparatus for joining one pipe section that contains a pressurized fluid, such as a pipe section formed from a non-metallic material in the sensing section of a drill string, to another pipe section so as to minimize the pressure gradient acting across the joint. An inner sleeve is installed within the pipe section so as to extend across the joint, thereby forming an annular chamber between the inner sleeve and the joint. Seals at the ends of the inner sleeve prevent the fluid flowing within the pipe section from flowing into the annular chamber. A vent hole allows fluid flowing outside the pipe section to enter the annular chamber and pressurize it to the same pressure as the fluid, thereby equalizing the pressure across the joint. Alternatively, the annular chamber can be filled with an incompressible fluid and a pressure balancing piston used to equalize the internal and external pressures acting on the joint. Or the annular chamber may be sealed from the pressures acting on the pipe section so that only a compressive force acts on the joint.

22 Claims, 4 Drawing Sheets

APPARATUS FOR JOINING SECTIONS OF PRESSURIZED CONDUIT

This application is a divisional of U.S. application Ser. No. 08/751,271 filed Nov. 18, 1996, now U.S. Pat. No. 5,816,344.

FIELD OF THE INVENTION

The current invention is directed to an apparatus for joining sections of pressurized conduit, such a section of composite pipe to a metal coupling in a drill string.

BACKGROUND OF THE INVENTION

In extracting petroleum from underground reserves, a bore is drilled deep into the earth. Such bores are formed by connecting a drill bit to a long pipe, referred to as a "drill pipe," so as to form an assembly commonly referred to as a "drill string" that extends from the surface to the bottom of the bore. The drill string is rotated, thereby causing the drill bit to advance into the earth, forming the bore. In order to lubricate the drill bit and flush cuttings from its path, a fluid, referred to as "drilling mud," is directed through an internal passage in the drill string and out through the drill bit. The drilling mud then flows to the surface through the annular passage formed between the drill string and the surface of the bore. Since the drilling mud must be highly pressurized, the drill string is subjected to a large pressure gradient in the radial direction, as well as high axial and torque loading due to the forces associated with rotating and advancing the drill bit and carrying the weight of the drill string; Consequently, the drill pipe must be especially strong. Moreover, since it is often necessary to form a curved bore, the drill pipe must also be flexible.

Traditionally, drill pipes have been formed by connecting sections of steel pipe, typically in lengths of about 30 feet. However, more recently, it has been proposed that drill pipes include sections of pipe formed from a composite material. According to one such approach, sections of composite pipe are interconnected using metallic couplings threaded on one end. The unthreaded end of the metallic coupling is bonded by an adhesive to an end of the composite pipe section, and the metallic couplings of adjacent composite pipe sections are threaded onto each other to form an assembly. Composite/metal pipe joints of this type are disclosed in U.S. Pat. No. 5,332,049 (Tew).

In addition to the drill bit, the distal end of a drill string, referred to as the "bottom hole assembly," often incorporates specialized sections, such as a stabilizer section, a sensing section, and an instrumentation/electrical section. These sections provide the drill operator with information concerning the formation being drilled through using techniques commonly referred to as "measurement while drilling" (MWD) or "logging while drilling" (LWD). In some cases, this information is used to control the direction in which the drill bit advances.

The sensor section may contain many different sensors some of which may include a transmitter and one or more receivers. The transmitter generates high frequency wavelength signals (e.g., electromagnetic waves) that travel through the formation surrounding the sensor and are then received by the receiver. By comparing the transmitted and received signals, information can be determined concerning the nature of the formation through which the signal traveled, such as whether it contains water or hydrocarbons. One such method for sensing and evaluating the characteristics of the formation is disclosed in U.S. Pat. No. 5,144,245 (Wisler), hereby incorporated by reference in its entirety. Other sensing methods under development include magnetic resonance imaging (MRI) such as that disclosed in U.S. Pat. No. 5,280,243 (Miller), hereby incorporated by reference in its entirety. Regardless of the method used, the information from the sensing section is typically transmitted to the surface so that the drilling personnel can use it in guiding the path of the drill bit.

The sensing section cannot be formed by merely incorporating transmitting and receiving antennas directly into a metal pipe section since metal will short out and/or distort the signal. Consequently, antennas are typically installed in non-conductive material. In the past, sensing sections have been formed by coating a section of metal pipe having a reduced diameter with an insulating material. The transmitter and receiver are placed on the insulating layer and then covered with a second insulating layer, such as fiberglass, rubber or epoxy, for protection. Since the body of the sensing section is composed of a metal pipe section, the sensing section can be readily connected into the bottom hole assembly using standard threaded metal couplings. A sensing section of this type is disclosed in the aforementioned U.S. Pat. No. 5,280,243 (Miller).

Unfortunately, this approach is not workable in small diameter drill strings. When the diameter of the metal pipe section supporting the insulating layers is reduced, the section becomes weaker and eventually is unable to withstand the mechanical forces imposed on the drill string. Moreover, in the case of MRI, the proximity of the metal pipe section interferes with the electromagnetic waves, thus distorting the analysis of the formation.

Consequently, it would be desirable to form a sensing section from a piping section formed from an electrically non-conductive and/or non-magnetic material, such as a composite material, so as to avoid the use of an underlying metallic pipe section. Unfortunately, this approach creates difficulties in joining the sensing section to the adjacent metallic members (e.g., the pipe couplings connecting the sensing section to the adjacent drill string sections). Traditional methods of joining non-metallic pipe sections, such as composite pipes, to metallic pipe couplings results in weak joints. Consequently, the large radial pressure gradient imposed across the joint as a result of the difference in the pressure of the drilling mud inside and outside of the drill string, combined with the high axial and torque loads, can cause failure of the joint (e.g., leaks).

Consequently, it would be desirable to provide an apparatus for connecting a section of an electrically non-conductive and/or non-magnetic conduit capable of carrying a pressurized fluid, such as a sensing section in a drill string, to a metallic coupling in such a way as to minimize the radial pressure gradient acting across the joint.

SUMMARY OF THE INVENTION

It is an object of the current invention to provide an apparatus for connecting a section of electrically non-conducting and/or non-magnetic pipe, such as a composite pipe, capable of carrying a pressurized fluid, to a metallic coupling in such a way as to minimize the radial pressure gradient acting across the joint. In one embodiment of the invention, this and other objects is accomplished in the sensor section of a drill string for drilling a bore through a formation that includes a plurality of sections through which a pressurized fluid flows. The sensing section is comprised of (i) a conduit formed from an electrically non-conductive material, the conduit having a passage formed therethrough, (ii) a sensor having means for sensing a characteristic of the formation, the sensor enclosed by the conduit, (iii) a coupling for connecting the conduit to one of the plurality of sections, the coupling joined to the conduit so as to form a joint therebetween, (iv) an inner sleeve having a passage formed therethrough for directing flow of the pressurized fluid, at least a portion of the inner sleeve disposed in the conduit passage and extending across the joint so as to form an annular chamber between the joint and the inner sleeve, (v) means for preventing flow communication between the pressurized fluid and the annular chamber, and (vi) means for reducing the pressure differential between the annular chamber and the bore.

The present invention also encompasses a conduit assembly for containing a pressurized fluid that is pressurized to a pressure greater than the pressure of the environment surrounding the conduit assembly so as to create a pressure gradient between the pressurized fluid and the environment. The conduit assembly comprises (i) a first conduit section, (ii) a connector having means for connecting-to a second conduit section, the connector joined to the first conduit section so as to form a joint therebetween, (iii) an inner sleeve having a passage for containing the pressurized fluid, the inner sleeve being enclosed by the first conduit section and the connector and extending across the joint so as to form an annular chamber between the joint and the inner sleeve, and (iv) means for equalizing the pressure in the annular chamber and the pressure of the environment surrounding the conduit assembly so as to prevent the pressure gradient from acting across the joint.

DESCRIPTION OF THE PREFERRED EMBODIMENT

Figure 1:
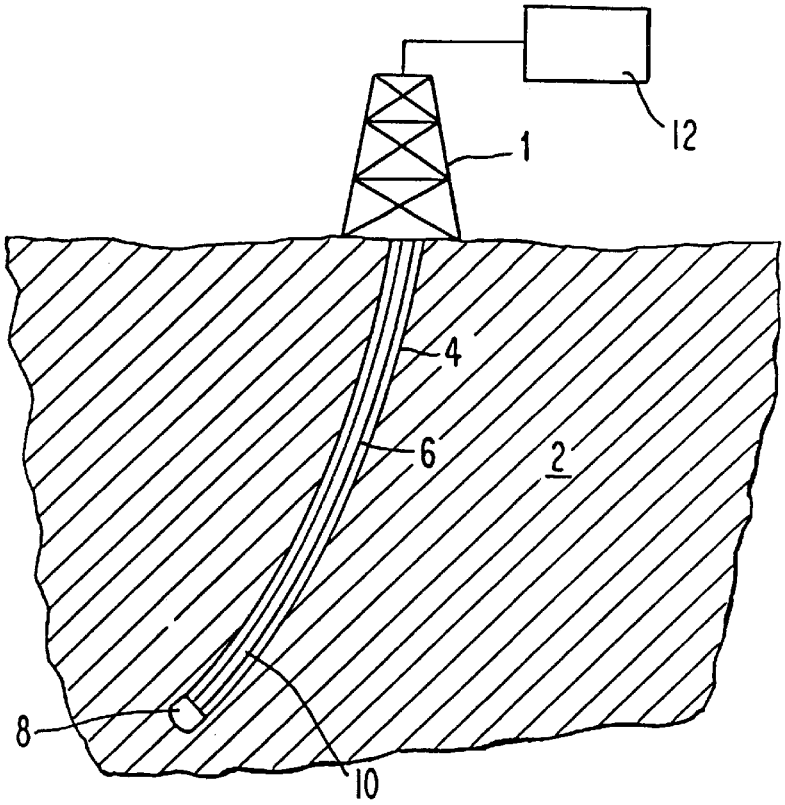
FIG. 1 is a schematic view of a drilling operation.

A drilling operation according to the current invention is shown in FIG. 1. A drill rig 1 drives a drill string 6 that, as is conventional, is comprised of a number of interconnecting sections. A bottom hole assembly 10 is formed at the distal end of the drill string 6. The bottom hole assembly 10 includes a drill bit 8 that advances to form a bore 4 in the surrounding formation 2.

Figure 2:
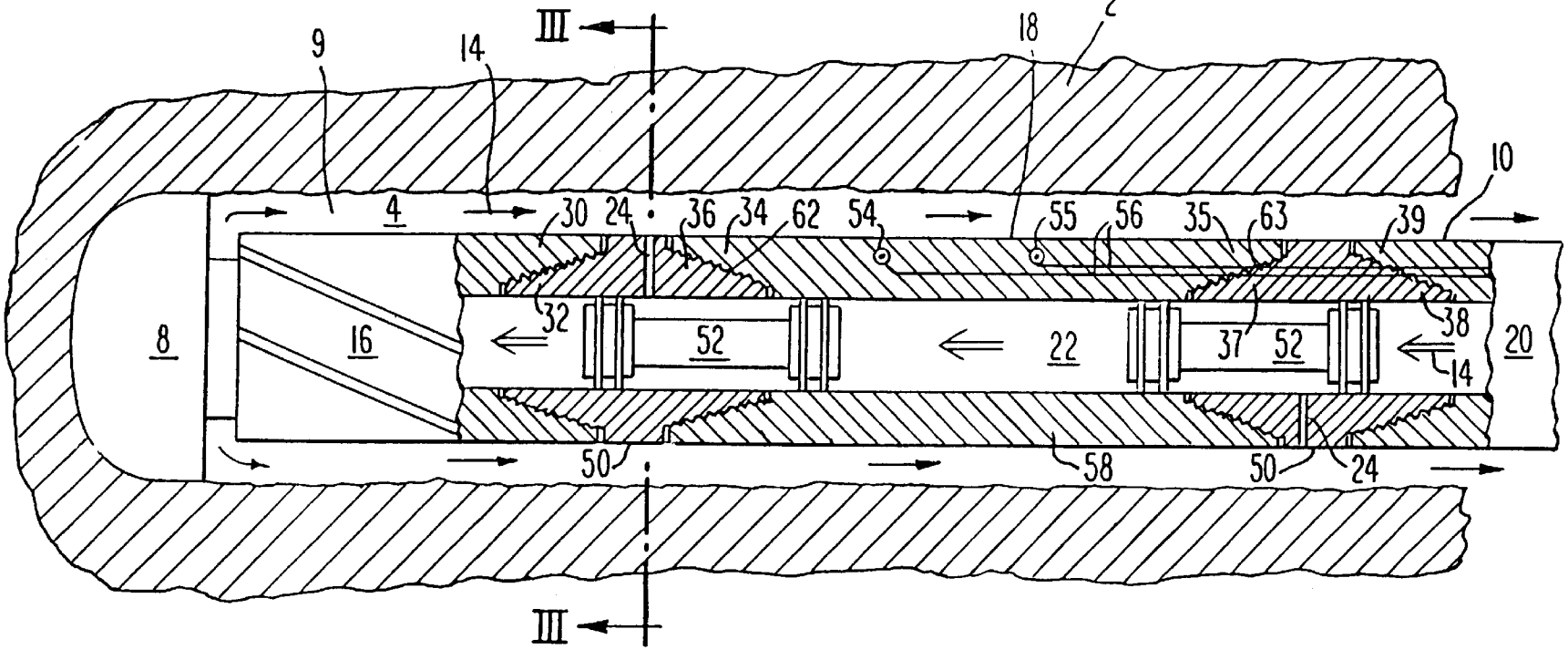
FIG. 2 is a longitudinal cross-section through the bottom hole assembly portion of the drill string shown in FIG. 1.

As shown in more detail in FIG. 2, in one embodiment of the invention, the bottom hole assembly 10 is comprised of a drill bit 8, a stabilizer section 16, a sensing section 18, and an electrical section 20. However, as those skilled in the art will readily appreciate, many different configurations of bottom hole assemblies can be used. A centrally disposed passage 22 is formed within the drill string 6 sections and allows drilling mud 14 to be pumped from the surface down to the drill bit 8. After exiting the drill bit 8, the drilling mud 14 flows up through an annular passage 9 formed between the outer surface of the drill string 6 and the internal diameter of the bore 4, for return to the surface. Depending on the drilling operation, the pressure of the drilling mud 14 flowing through the drill string internal passage 22 will typically be between 1,000 and 20,000 psi. In addition, there is a large pressure drop at the drill bit 8. Consequently, the pressure of the drilling mud 14 flowing through the annular passage 9 (that is, outside of the drill string 6) may be 200 to 3,000 psi less than that of the pressure of the drilling mud flowing inside the drill string. Thus, a large pressure gradient acts radially across the drill string 6 sections. In addition to withstanding the pressure gradient, the sections of the drill string must also be sufficiently strong to withstand the torque, axial, and bending loads associated with the advancement and retraction of the drill bit 8.

According to one embodiment of the current invention, the sensing section 1–8 is comprised of a pipe section 58 that the encloses antennas 54 and 55, as shown in FIG. 2. The antenna 54 is a transmitting antenna that emits electromagnetic waves that travel through the surrounding formation 2 and are then received by a receiving antenna 55. Electrical signals from the antennas are transmitted via conductors 56 to the electrical section 20. As previously discussed, using techniques well known in the art, the electrical section 20 will analyze the signals and transmit information concerning the surrounding formation 2 to a data processing system 12 on the surface that provides an analysis of the characteristics of the formation, for example, in a manner that will facilitate guidance of the drill bit 8.

According to an important aspect of the current invention, to facilitate the performance of the antennas 54 and 55, the pipe section 58 is non-metallic and, preferably, is formed from a material that is electrically non-conductive and non-magnetic. As used herein, the term "electrically non-conductive" refers to materials having a conductance of less than about 1000 Siemens per meter. While small amounts of conductive material may used in the pipe section 58, its overall conductivity should preferably be equivalent to that of a homogeneous material having a conductivity of less than about 1000 Siemens per meter. Similarly, as used herein, the term "non-magnetic" refers to materials having a relative magnetic permeability of less than about 1.1.

While most materials that are electrically non-conductive will also be non-magnetic, it will generally not be necessary that the material be both electrically non-conductive and non-magnetic. For example, if the sensing section 18 employs a radio wave technique, it is only necessary that the material be electrically non-conductive so as to avoid interfering with the operation of the antennas. However, if MRI techniques are utilized, it is important that the material be non-magnetic as well as electrically non-conductive.

Most preferably, the pipe section 58 is formed from a composite material. As used herein, the term "composite material" refers generally to a material formed by imbedding fibers in a matrix. Various suitable composite materials are known in the art, including material formed from fibers made of glass (e.g., fiberglass), graphite, Kevlar™, etc. The fibers may be imbedded in matrices comprised of plastic resins such as polyesters, vinyl esters, polyamides, epoxies, and the like. In any event, as those skilled in the art will readily appreciate, the significant characteristic of the composite material is that it minimizes interference with the operation of the sensing components, which in the preferred embodiment are antennas.

In the embodiment of the invention shown in FIG. 2, the antennas 54 and 55 are embedded directly in pipe section 58, for example by wrapping or coating a wet layer of a composite material around a mandrel, placing the antennas on the first layer, wrapping or coating another wet layer over the first layer, and then curing the composite. This construction will adequately protect the antennas 54 and 55 from external forces while providing minimal interference with the electromagnetic waves on which they operate.

Preferably, the pipe section 58 has tapered ends on which pipe threads are tapped so as to form couplings 34 and 35. However, other mechanical or chemical joining techniques could also be utilized. As shown in FIG. 2, coupling 34 is connected to a standard metallic pipe connector 50, having threaded couplings 32 and 36 on each of its ends, so as to form a joint 62. An adhesive may be applied to further strengthen the joint 62, especially if the pipe section 58 is formed from a composite material. In addition, radial pins (not shown) may be placed through the joint 62 to provide further strength. The connector 50 connects the sensing section 18 to the stabilizer section 16. The coupling 35 on the opposite end of the pipe section 58 is connected in a similar manner to another standard pipe connector 50 so as to form a second joint 63. The second pipe connector 50 connects the sensing section 18 to the electrical section 20.

While a non-metallic pipe section, such as composite pipe section 58, provides an optimal material for enclosing the antennas 54 and 55, the strength of the joints 62 and 63 formed between such pipe section and the metallic connectors 50 may be insufficient to withstand the forces imparted to them. As previously discussed, as a result of the difference in pressure between the drilling mud 14 flowing down through the sensor section 18 and the drilling mud flowing up through the annular passage 9 surrounding the sensing section, a large radially outward acting force is imparted to the joints 62 and 63. This outward force tends to open the joints 62 and 63. Moreover, large axial and torque loads are imposed on the joints 62 and 63 as a result of the advancement and rotation of the drill bit 8. The combination of these loads can separate the joints 62 and 63, thereby resulting in failure of the drill string 6.

Consequently, it would be desirable to minimize the pressure gradient acting across the joints 62 and 63, leaving them free to withstand the maximum possible axial and torque loads. Therefore, according to another important aspect of the current invention, means are provided for significantly reducing, and preferably eliminating, the pressure gradient acting across the joints 62 and 63.

Figure 3:
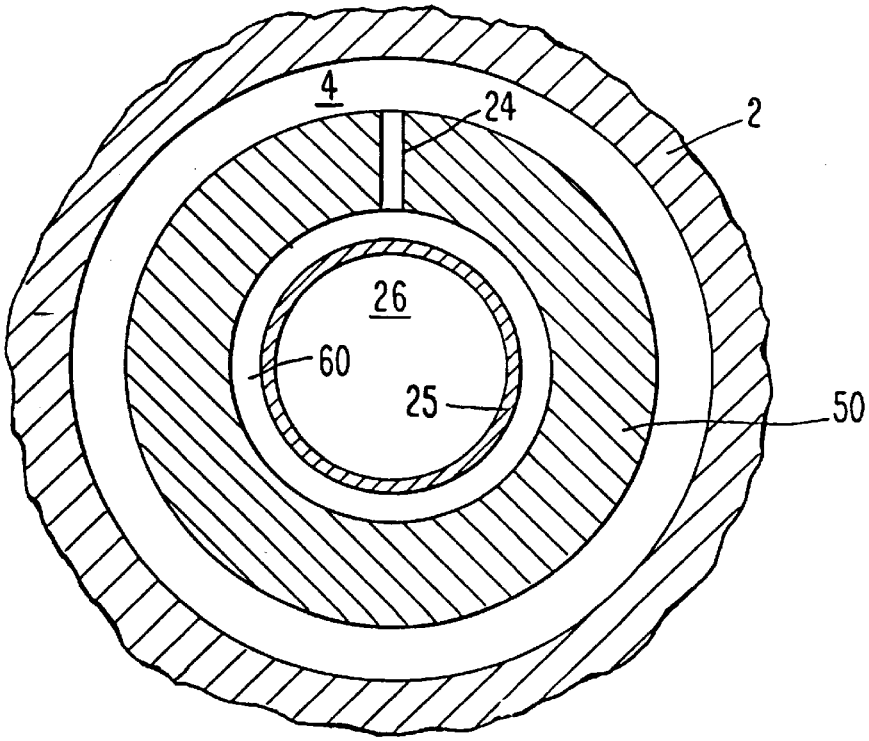
FIG. 3 is a transverse cross-section taken along line III—III shown in FIG. 2.
Figure 4:
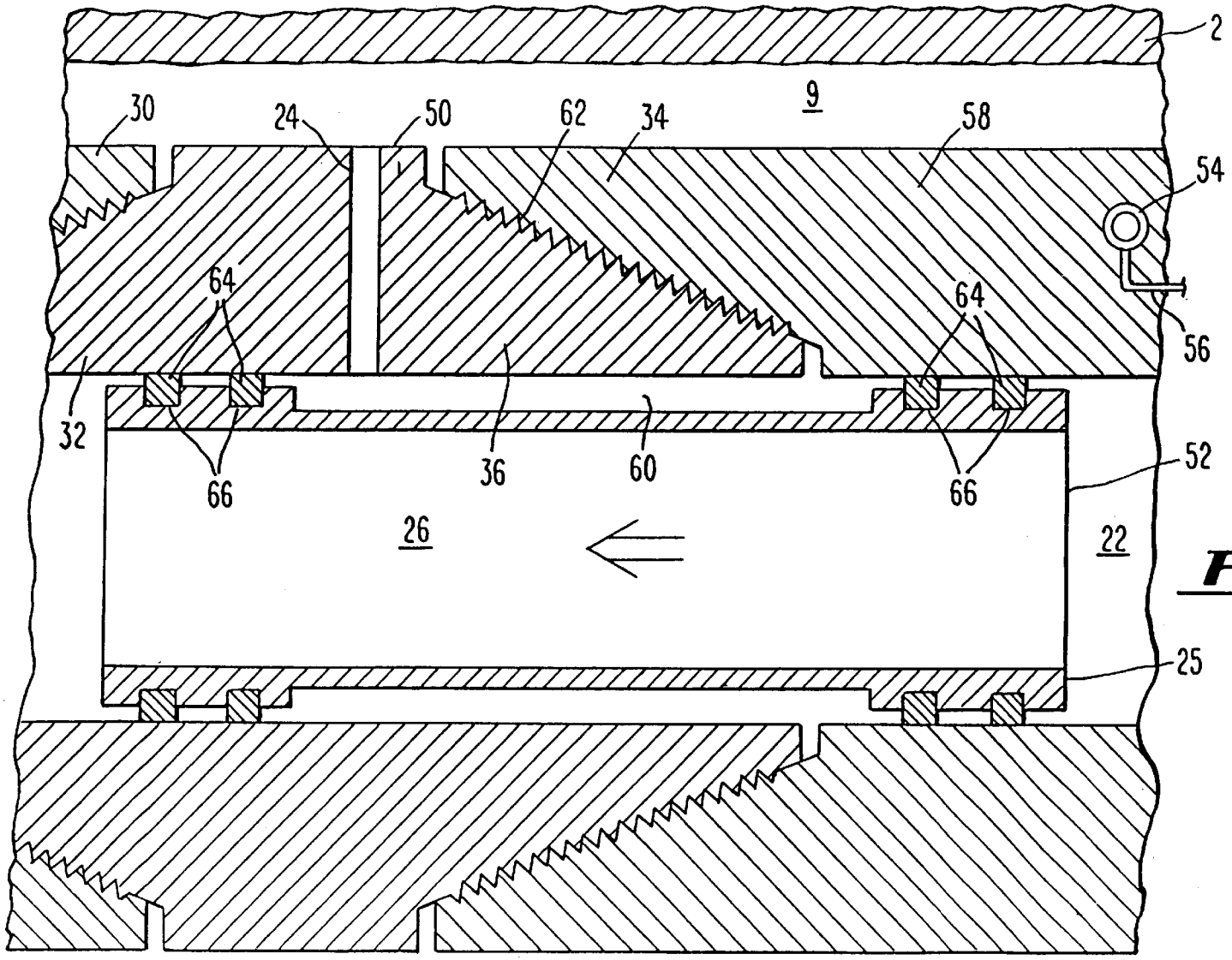
FIG. 4 is a detailed view of a portion of the sensing section of the bottom hole assembly shown in FIG. 2.

As shown in FIGS. 2–4, two inner sleeve assemblies 52 are disposed within the passage 22 formed in the pipe section 58 of the sensing section 18. One inner sleeve assembly 52 is disposed at each end of the pipe section 58 directly underneath the joints 62 and 63. As shown best in FIGS. 3 and 4, each inner sleeve assembly 52 extends across a joint so as to form an annular chamber 60 between it and the joint. As discussed below, the annular chambers 60 act as pressure equalization chambers. As shown in FIG. 4, each inner sleeve assembly 52 is comprised of a hollow inner sleeve 25, which forms a passage 26, and two sets of seals 64. Preferably, the inner sleeve 25 is formed from metal and is sufficiently thick to provide the strength necessary to withstand the pressure of the drilling mud 14 that flows through the internal passage 26 formed in the inner sleeve 25. However, the inner sleeve 25 should also be flexible enough to permit curvature of the drill string 6. The seals 64 are preferably O-ring seals and are installed in circumferential grooves 66 machined in the periphery of the inner sleeve 25. A pair of seals 64 are disposed adjacent each end of the inner sleeve 25. The seals 64 prevent the drilling mud 14 flowing through the sensor section 18 from entering the chamber 60.

According to an important aspect of the current invention, means are provided for reducing the pressure gradient acting across the joints 62 and 63. According to the embodiment shown in FIGS. 2–4, a radially extending vent hole 24 is formed in each of the metallic pipe connectors 50. In operation, the vent holes 24 allow the drilling mud 14 flowing upward through the annular passage 9 to flow into and pressurize the chamber 60. Thus, the pressure on each side of the joints 62 and 63 is essentially equalized so that both the internal pressure (the pressure in the annular chamber 60) and the external pressure (the pressure in the annular passage 9) are essentially the same, thereby eliminating the radial pressure force acting outwardly on the joints. Alternatively, the vent holes 24 could be formed in each end of the pipe section 58

Figure 5:
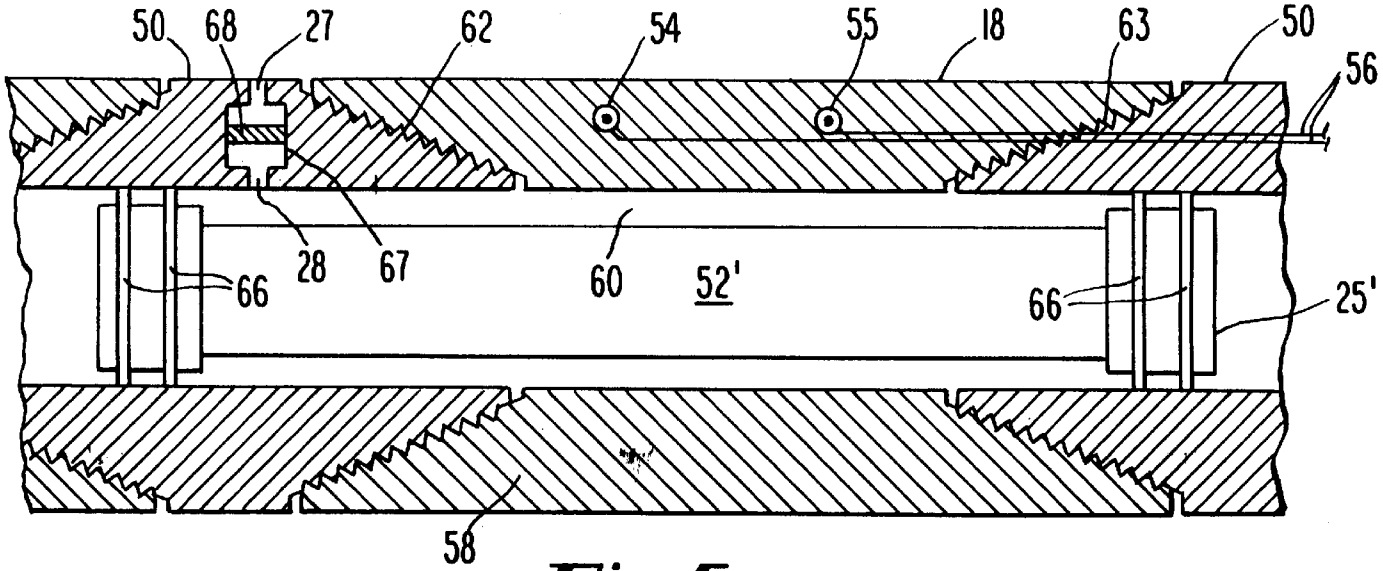
FIG. 5 is an alternate embodiment of the sensing section of the current invention.

FIG. 5 shows an alternate embodiment of the invention. In this embodiment, a single inner sleeve assembly 52' is installed so that the inner sleeve 25' extends across both of the joints 62 and 63 on the ends of the pipe section 58. In this approach, the inner sleeve 25' creates a single pressure equalization annular chamber 60 that essentially eliminates the pressure gradient acting across both of the joints 62 and 63 and, in fact, across the entire pipe section 58. As also shown in FIG. 5, a pressure balancing piston 68 is slidably installed in a close fitting cylinder 67 formed in the connector 50. Narrow passages 27 and 28 connect the portions of the cylinder 67 on opposing sides of the piston 68 to the annular passage 9 and the annular pressure equalization chamber 60, respectively. While a pressure balancing piston assembly is shown in FIG. 5, it should be understood that the vent hole 24 discussed above in connection with the embodiment shown in FIG. 2 could also be used in this embodiment. Similarly, the pressure balancing piston assembly shown in the embodiment of FIG. 5 may be used in the embodiment shown in FIG. 2.

If the pressure balancing piston is utilized, the annular chamber 60 is preferably filled with a relatively incompressible fluid, such as water or oil, at assembly. As the bottom hole assembly 10 proceeds into the formation 2 and the pressure rises in the drilling mud 14 flowing through the annular passage 9, the drilling mud will flow into passage 27 and exert a force tending to drive the piston 68 radially inward. The motion of the piston 68 will reduced the volume connected to the annular chamber 60 thereby increasing the pressure of the fluid within the chamber. The piston 68 will continue moving in the cylinder 67 until the pressure of the fluid within the annular chamber 60 equals that of the drilling mud 14 flowing through the annular passage 9, thereby essentially eliminating the pressure gradient acting across the joints 62 and 63.

The pressure balancing piston arrangement shown in FIG. 5 has several potential advantages over the vent hole arrangement shown in FIGS. 2–4. Since the annular chamber 60 is pre-filled, contamination of the annular chamber with drilling mud is avoided. Moreover, since the amount of drilling mud 14 flowing through the passage 27 is relatively small, the pressure balancing piston arrangement avoids the danger associated with the plugging of the vent hole 24 by foreign matter carried along with the flow of drilling mud 14.

Figure 6:
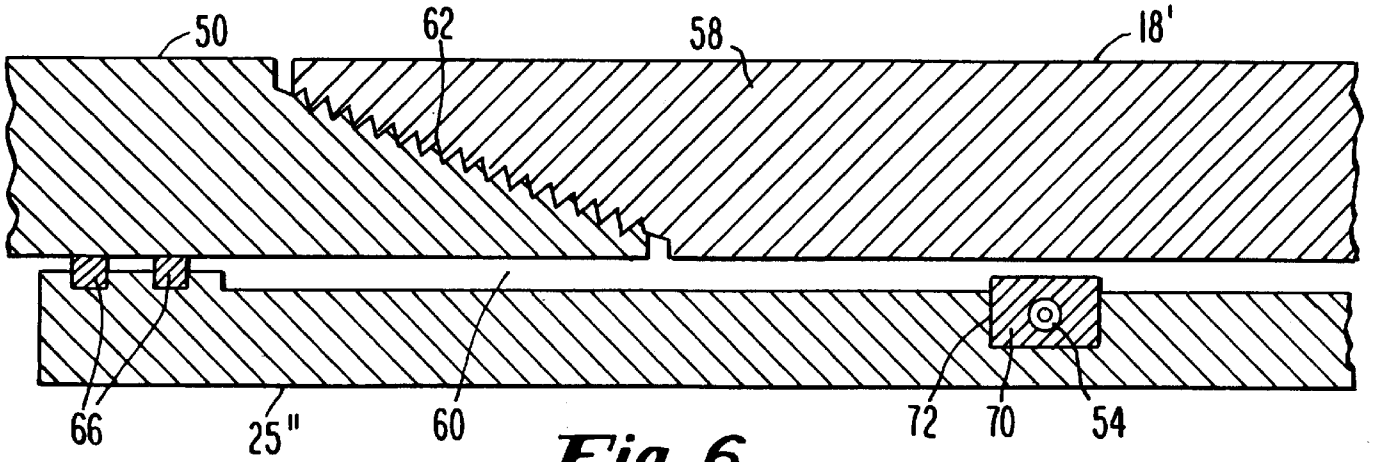
FIG. 6 is another alternate embodiment of the sensing section of the current invention.

Yet another embodiment of the invention is shown in FIG. 6. In that embodiment, the thickness of the inner sleeve 25", which again is preferably formed from metal, has been increased and a circumferential slot 72 machined in the outer diameter of the sleeve. The antenna 54 is then embedded in a non-conducting material 70, such as a composite, formed within the slot 72. The antenna 55 is similarly installed in another circumferential slot (not shown). Thus, although the pipe section 58 encloses the antennas, as before, they are not embedded in the pipe section. While either of the pressure equalization devices previously discussed could be used in this embodiment as well, another approach is shown in FIG. 6. Specifically, in this embodiment, no attempt is made to increase the pressure within the chamber 60, which is preferably empty and remains at atmospheric pressure. Since the inner sleeve 25" prevents the pressure of the inside drilling mud 14 from acting outwardly on the joint 62, there is a pressure differential across the joints that is equal to the difference between the pressure of the outside drilling mud and atmospheric pressure. While this approach does not eliminate the pressure gradient acting on the joints, the fact that the pressure gradient acts inwardly means that it imparts a compressive force that tends so to keep the joint 62 closed. This is in contrast to what occurs when no inner sleeve is utilized and an outward force tends to open the joint.

Although the present invention has been discussed with reference to a sensing section in a drill string, the invention is also applicable in other situations, such as connecting ordinary pipe sections in a drill string or other piping assembly exposed to pressure loading. Consequently, the present invention may be embodied in other specific forms without departing from the spirit or essential attributes thereof and, accordingly, reference should be made to the appended claims, rather than to the foregoing specification, as indicating the scope of the invention.

What is claimed:

1. A sensing section for use in a drill string for drilling a bore through a formation, a pressurized fluid flowing through an annular passage formed between the exterior surface of said drill string and said bore, said drill string including a plurality of sections having internal passages extending therethrough through which said pressurized fluid flows prior to flowing through said annular passage, the pressure of said fluid flowing through said internal passages being greater than the pressure of said fluid flowing through said annular passage so that an outward pressure gradient generally acts across said drill string, said sensing section comprising:

a) a conduit formed from an electrically non-conductive material, said conduit having a passage formed therethrough, said conduit having an exterior surface that forms a portion of said exterior surface of said drill string, whereby said pressurized fluid flowing through said annular passage flows over said conduit external surface;

b) a sensor having means for sensing a characteristic of said formation, said sensor enclosed by said conduit;

c) a coupling for connecting said conduit to one of said plurality of sections of said drill string, said coupling joined to said conduit so as to form a joint therebetween;

d) an inner sleeve having an internal passage formed therewithin for directing flow of said fluid through said internal passages of said drill string sections, at least a portion of said inner sleeve disposed in said conduit passage and extending across said joint;

e) an annular chamber formed between said joint and said inner sleeve, the pressure in said annular chamber being substantially atmospheric pressure; and f) means for maintaining said annular chamber at said substantially atmospheric pressure when said sensing section is disposed in said bore despite the presence of said pressurized fluid flowing over said external surface of said conduit and despite the presence of said pressurized fluid flowing through said internal passage formed within said inner sleeve so that the pressure of said fluid flowing over said external surface of said conduit imparts a compressive force on said joint, said pressure maintaining means comprising means for preventing flow communication between said fluid and said annular chamber.

2. The sensing section according to claim 1, wherein said joint has a longitudinal length, and wherein said annular chamber extends under substantially the entirety of said joint longitudinal length.

3. The sensing section according to claim 1, wherein said conduit and said coupling each have threads that are interengaged so as to define a longitudinal length of said joint, and wherein said annular chamber extends under substantially the entirety of said joint longitudinal length.

4. The sensing section according to claim 1, wherein said annular chamber has first and second ends, and wherein said means for preventing flow communication between said pressurized fluid and said annular chamber comprises first and second seals disposed proximate said first and second ends of said annular chamber, respectively, each of said first and second seals extending between said inner sleeve and said conduit.

5. The sensing section according to claim 1, wherein said sensor is embedded in said electrically non-conductive material forming said conduit.

6. The sensing section according to claim 1, wherein at least a portion of said inner sleeve is formed from an electrically non-conductive material, and wherein said sensor is embedded in said electrically non-conductive material forming said portion of said inner sleeve.

7. The sensing section according to claim 1, wherein said means for sensing a characteristic of said formation comprises a first antenna for transmitting electromagnetic waves into said formation.

8. The sensing section according to claim 7, wherein said means for sensing a characteristic of said formation further comprises a second antenna for receiving said electromagnetic waves transmitted by said first antenna.

9. The sensing section according to claim 7, wherein said non-conductive material forming said conduit is a composite material.

10. The sensing section according to claim 1, wherein said conduit has first and second ends, and wherein said coupling is a first coupling and said joint is a first joint, said first coupling being joined to said first end of said conduit, and further comprising a second coupling, said second coupling joined to said second end of said conduit so as to form a second joint therebetween, at least a portion of said inner sleeve extending across said second joint so that at least a portion of said annular chamber is disposed between said second joint and said inner sleeve.

11. The sensing section according to claim 1, wherein said coupling comprises a threaded portion of a pipe connector.

12. A sensing section for use in a drill string for drilling a bore through a formation, a pressurized fluid flowing through an annular passage formed between the exterior surface of said drill string and said bore, said drill string including a plurality of sections having internal passages extending therethrough through which said pressurized fluid flows prior to flowing through said annular passage, the pressure of said fluid flowing through said internal passages being greater than the pressure of said fluid flowing through said annular passage so that an outward pressure gradient generally acts across said drill string, said sensing section comprising:

a) a conduit formed from a non-magnetic material, said conduit having a passage formed therethrough, said conduit having an exterior surface that forms a portion of said exterior surface of said drill string, whereby said pressurized fluid flowing through said annular passage flows over said conduit external surface;

b) a sensor having means for sensing a characteristic of said formation, said sensor enclosed by said conduit;

c) a coupling for connecting said conduit to one of said plurality of sections of said drill string, said coupling joined to said conduit so as to form a joint therebetween;

d) an inner sleeve having internal passage formed therewithin for directing flow of said fluid through said internal passages of said drill string sections, at least a portion of said inner sleeve disposed in said conduit passage and extending across said joint;

e) an annular chamber formed between said joint and said inner sleeve, the pressure in said annular chamber being substantially atmospheric pressure; and e) means for maintaining said annular chamber at said substantially atmospheric pressure when said sensing section is disposed in said bore despite the presence of said pressurized fluid flowing over said external surface of said conduit and despite the presence of said pressurized fluid flowing through said internal passage formed within said inner sleeve so that the pressure of said fluid flowing over said external surface of conduit imparts a compressive force on said joint, said pressure maintaining means comprising means for preventing flow communication between said fluid and said annular chamber.

13. The sensing section according to claim 12, wherein said joint has a longitudinal length, and wherein said annular chamber extends under substantially the entirety of said joint longitudinal length.

14. The sensing section according to claim 12, wherein said conduit and said coupling each have threads that are inter-engaged so as to define a longitudinal length of said joint, and wherein said annular chamber extends under substantially the entirety of said joint longitudinal length.

15. The sensing section according to claim 12, wherein said annular chamber has first and second ends, and wherein said means for preventing flow communication between said pressurized fluid and said annular chamber comprises first and second seals disposed proximate said first and second ends of said annular chamber, respectively, each of said first and second seals extending between said inner sleeve and said conduit.

16. The sensing section according to claim 12, wherein said sensor is embedded in said non-magnetic material forming said conduit.

17. The sensing section according to claim 12, wherein at least a portion of said inner sleeve is formed from an electrically non-conductive material, and wherein said sensor is embedded in said electrically non-conductive material forming said portion of said inner sleeve.

18. The sensing section according to claim 12, wherein said means for sensing a characteristic of said formation comprises a first antenna for transmitting electromagnetic waves into said formation.

19. The sensing section according to claim 18, wherein said means for sensing a characteristic of said formation further comprises a second antenna for receiving said electromagnetic waves transmitted by said first antenna.

20. The sensing section according to claim 18, wherein said non-magnetic material forming said conduit is a composite material.

21. The sensing section according to claim 12, wherein said conduit has first and second ends, and wherein said coupling is a first coupling and said joint is a first joint, said first coupling being joined to said first end of said conduit, and further comprising a second coupling, said second coupling joined to said second end of said conduit so as to form a second joint therebetween, at least a portion of said inner sleeve extending across said second joint so that at least a portion of said annular chamber is disposed between said second joint and said inner sleeve.

22. The sensing section according to claim 12, wherein said coupling comprises a threaded portion of a pipe connector.

* * * * *